US011828498B2

(12) United States Patent
Joshi et al.

(10) Patent No.: US 11,828,498 B2
(45) **Date of Patent: *Nov. 28, 2023**

(54) MULTI MODE HEAT TRANSFER SYSTEMS

(71) Applicant: Toyota Motor Engineering & Manufacturing North America, Inc., Plano, TX (US)

(72) Inventors: Shailesh N. Joshi, Ann Arbor, MI (US); Ercan M. Dede, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 224 days.

This patent is subject to a terminal disclaimer.

(21) Appl. No.: 17/378,125

(22) Filed: Jul. 16, 2021

(65) Prior Publication Data

US 2023/0019971 A1 Jan. 19, 2023

(51) Int. Cl.
*F25B 23/00* (2006.01)
*F28F 13/18* (2006.01)

(52) U.S. Cl.
CPC ..... *F25B 23/003* (2013.01); *F28F 13/18* (2013.01); *F28F 2245/06* (2013.01)

(58) Field of Classification Search
CPC ..... B01J 19/12; F25B 23/003; F28F 13/18; F28F 2013/008; F28F 2245/06;
(Continued)

(56) References Cited

U.S. PATENT DOCUMENTS 6,500,555 B1 12/2002 Khaldi
9,927,188 B2 * 3/2018 Liu ..... F28F 3/00
(Continued)

FOREIGN PATENT DOCUMENTS

CN 105758182 B 9/2018
WO 2014148585 A1 9/2014

OTHER PUBLICATIONS

Sydney Taylor; "Dynamic Radiative Thermal Management and Optical Force Modulation with Tunable Nanophotonic Structures Based on Thermochromic Vanadium Dioxide", Dec. 2020, 137 pages, https://repository.asu.edu/attachments/236403/content/Taylor_asu_0010E_20525.pdf.

*Primary Examiner* — Eric S Ruppert
*Assistant Examiner* — Hans R Weiland
(74) *Attorney, Agent, or Firm* — Dinsmore & Shohl LLP

(57) ABSTRACT

Embodiments described herein generally relate a multi-mode heat transfer system. The heat transfer system includes an emitter device. The emitter device includes an inner core, a composite material pattern, and a surface coating pattern. The inner core is surrounded by an outer core having a thickness and an outer surface. The composite material pattern extends through at least a portion of the outer surface and at least a portion of the thickness of the outer core and is thermally coupled to the inner core. The surface coating pattern is on the outer surface and is changeable between a low emissivity state and a high emissivity state based on a surface temperature of the emitter device. In the low emissivity state, the emitter device transmits an omni-directional radiation and, in the high emissivity state, the emitter device transmits a focused radiation via the composite material pattern.

20 Claims, 10 Drawing Sheets

(58) Field of Classification Search
CPC ..... G02B 1/002; G02F 2202/30; H05B 3/009; H05B 3/12; H05B 3/48
See application file for complete search history.

(56) References Cited

U.S. PATENT DOCUMENTS

| | | | | |
|---|---|---|---|---|
| 10,323,151 | B2 | 6/2019 | Van Overmeere et al. | |
| 10,591,190 | B2 | 3/2020 | Yoshihiro et al. | |
| 2002/0167800 | A1* | 11/2002 | Smalc | H01L 23/373 174/15.2 |
| 2004/0233549 | A1* | 11/2004 | Feygin | G02B 13/14 359/356 |
| 2018/0374981 | A1 | 12/2018 | Carr | |
| 2020/0026999 | A1 | 1/2020 | Wang et al. | |
| 2021/0184065 | A1* | 6/2021 | Banadaki | G02F 1/025 |
| 2022/0384302 | A1* | 12/2022 | Childress | H01L 23/3677 |

* cited by examiner

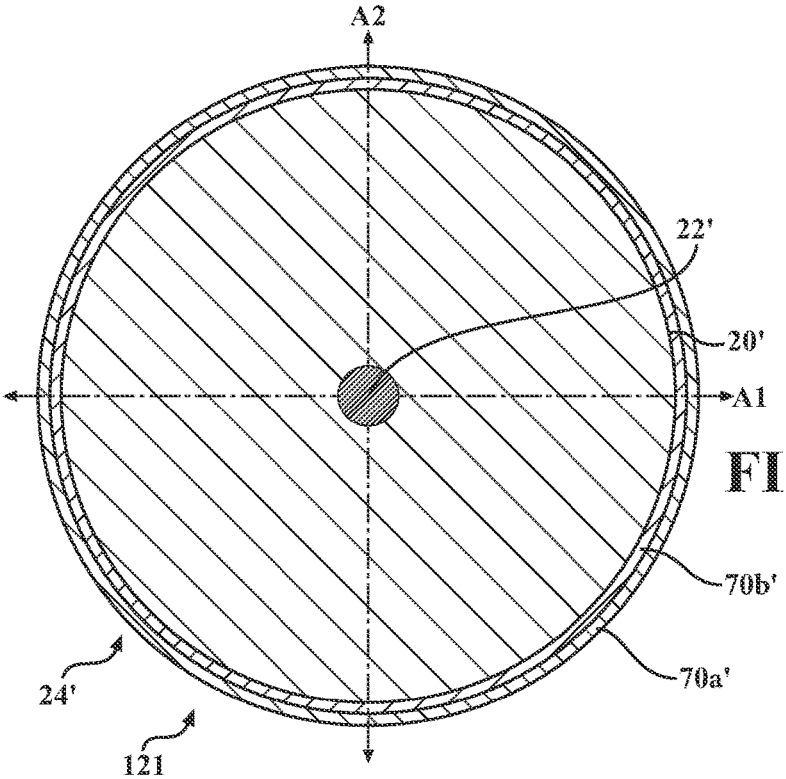
FIG. 2A
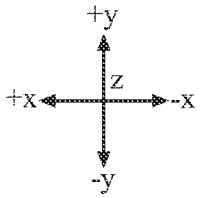
FIG. 2B
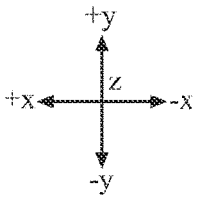
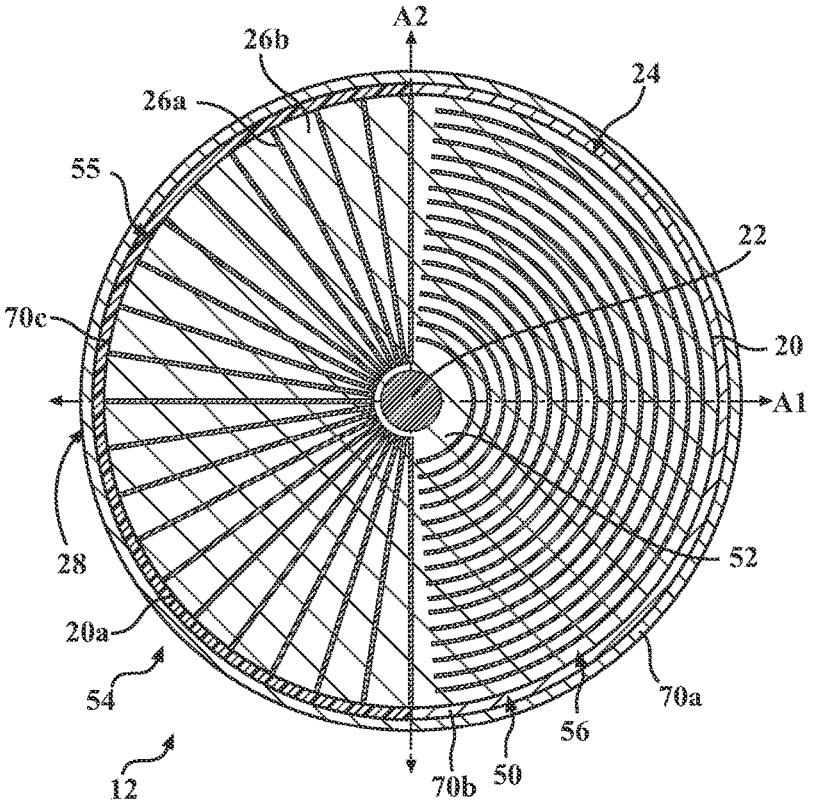

MULTI MODE HEAT TRANSFER SYSTEMS

TECHNICAL FIELD

The present specification generally relates to heat transfer systems and, more specifically, directing radiated heat from one object to another object as a function of temperature.

BACKGROUND

Heat transfer systems generally use heat conduction and/or heat radiation principles. In these systems, heat is transferred via conduction and/or radiation amongst objects near a heat source. Most commonly, heat-receiving structures are positioned to surround the heat source. As such, as heat is emitted from the heat source, each of the heat receiving structures receives a portion of the heat emitted from the heat source. This is inefficient, is not dependent on a temperature of the heat source, and does not direct the heat to a specific heat receiving structures as a function of the temperature of the heat source.

SUMMARY

In one embodiment, a multi-mode heat transfer system is provided. The heat transfer system includes an emitter device. The emitter device includes an inner core, a composite material pattern, and a surface coating pattern. The inner core is surrounded by an outer core having a thickness and an outer surface. The composite material pattern extends through at least a portion of the outer surface and at least a portion of the thickness of the outer core and is thermally coupled to the inner core. The surface coating pattern is on the outer surface and is changeable between a low emissivity state and a high emissivity state based on a surface temperature of the emitter device. In the low emissivity state, the emitter device transmits an omni-directional radiation and, in the high emissivity state, the emitter device transmits a focused radiation via the composite material pattern.

In another embodiment, a power transfer system is provided. The power transfer system includes an emitter device, a first receiver device and a second receiver device. The emitter device includes an inner core, an outer core, a composite material pattern, and a surface coating pattern. The outer core has a thickness that circumferentially surrounds the inner core. The outer core having materials that includes at least one high thermal conductivity material inlay and a low thermal conductivity material matrix. The composite material pattern is formed by the materials. The composite material pattern extends a length of the emitter device in a system vertical direction and is positioned within a portion of the thickness of the outer core. The emitter device is positioned spaced part from and in between the first and second receiver devices. The surface coating pattern on the outer surface is changeable between a low emissivity state and a high emissivity state based on a surface temperature of the emitter device. In the low emissivity state, the emitter device transmits an omni-directional radiation to the first and second receiver devices, and, in the high emissivity state, the emitter device transmits a focused radiation via the composite material pattern to the first receiver device.

In yet another embodiment, a method of forming a surface coating pattern of an emitter device in a power transfer system such that the emitter device has a switchable emissivity profile based on a function of a temperature of the emitter device is provided. The method includes masking a first portion of the emitter device, applying a first thermochromic material to circumferentially cover at least a second portion of an outer surface of the emitter device, removing the mask from the first portion of the emitter device and masking the second portion of the emitter device. The method continues by applying a second thermochromic material to circumferentially cover at least the first portion of the outer surface of the emitter device and applying a third thermochromic material to cover the first thermochromic material and the second thermochromic material of the emitter device.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

FIG. 2A schematically depicts a cross-sectional view of a solid emitter device of the heat transfer system of FIG. 1A taken from line 2-2, according to one or more embodiments shown and described herein;

FIG. 2B schematically depicts a cross-sectional view of a first aspect of a composite material pattern of the emitter device of the heat transfer system of FIG. 1A taken from line 2-2, according to one or more embodiments shown and described herein;

DETAILED DESCRIPTION

Figure 1A:
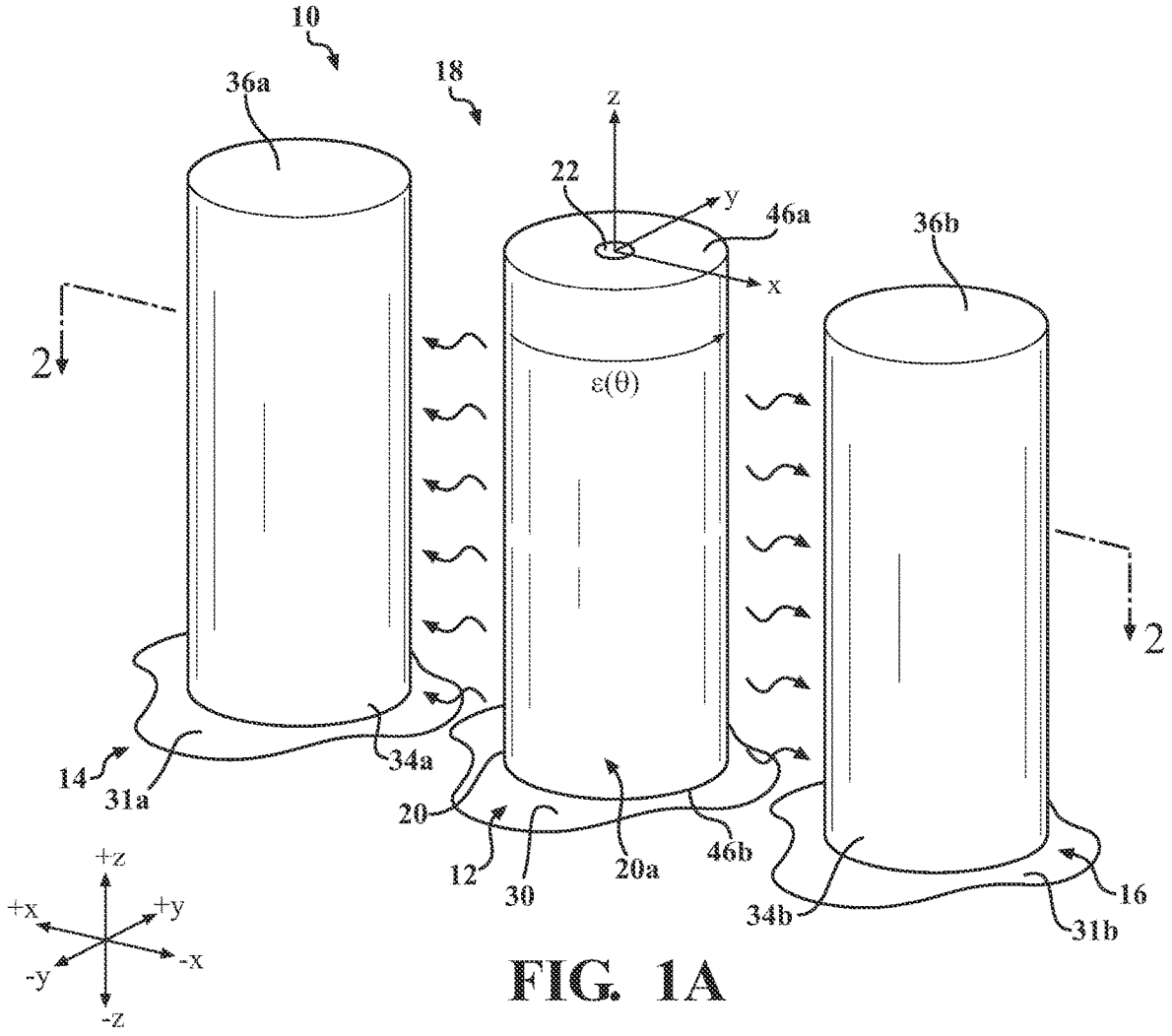
FIG. 1A schematically depicts a perspective and side view of a heat transfer system that includes an emitter device positioned between a pair of spaced apart receiver devices, according to one or more embodiments shown and described herein.

Embodiments described herein generally relate to a multi-mode (i.e., low and high emissivity profiles) heat transfer system. In some embodiments, the multi-mode heat transfer system is used in thermal protection systems. In other embodiments, the multi-mode heat transfer system is used in high temperature thermal energy harvesting and the like. The multi-mode heat transfer system includes an emitter device and a pair of spaced apart receiver devices. The emitter device is positioned to selectively transmit a heat and/or power in the far field towards a colder body receiver, such as the at least one of the pair of spaced apart receiver devices. As such, the multi-mode heat transfer system, as a function of temperature of the emitter device, moves and directs heat from the emitter device, either omni-directional or focused, to an area where the heat may be beneficial and/or may not cause harm. For example, heat generated by a hot body engine may be directed, by the emitter device, as focused heat to one of the pair of receiver devices positioned in an engine compartment area that has ample intake of air to remove the heat to the environment. In another example, heat generated by the hot body engine may be directed, by the emitter device, to an area around the pair of receiver devices positioned in the engine compartment area that has ample intake of air to remove the heat to the environment. In another example, heat generated by a component in an aerospace application, such as a hot body solar receiver, may be directed, by the emitter device, to another receiving device, such as a sail that is coupled to another component (e.g., a fly-by-light sailcraft) that requires, or works more efficient, when receiving heat and associated directed radiated power. Other applications are also possible.

In embodiments, the emitter device may be generally cylindrical in shape with an outer core that has a thickness and circumferentially surrounds an inner core. A composite material pattern extends through at least a portion of the outer surface and at least a portion of the thickness of the outer core. The composite material pattern is thermally coupled to the inner core. A surface coating pattern is spun, coated, or otherwise provided on the outer surface and enables the emitter device to provide for different emissivity states based on a surface temperature of the emitter device. For example, the different emissivity states may be a change between a low emissivity state and a high emissivity state. The surface coating pattern includes, for example, a first coating material, a second coating material and a third coating material, in which each are all different materials. The first coating material covers portions of the outer surface of the emitter device and is activated when the surface temperature of the outer surface of the emitter device is below a predetermined temperature threshold. The second coating material covers only the composite material pattern of the outer surface of the emitter device and is activated when the surface temperature of the outer surface of the emitter device is above a predetermined temperature threshold. The third coating material circumferentially covers the first and second coating materials. Therefore, the surface coating pattern permits the emitter device to have a switchable radiosity as a function of temperature such that, in the low emissivity state, the emitter device transmits an omni-directional radiation and, in the high emissivity state, the emitter device transmits a focused radiation via the composite material pattern.

As used herein, the term "system longitudinal direction" refers to the forward-rearward direction of the system (i.e., in the +/−X-direction depicted in FIG. 1A). The term "system lateral direction" refers to the cross-system direction (i.e., in the +/−Y-direction depicted in FIG. 1A), and is transverse to the longitudinal direction. The term "system vertical direction" refers to the upward-downward direction of the system (i.e., in the +/−Z-direction depicted in FIG. 1A).

Figure 1B:
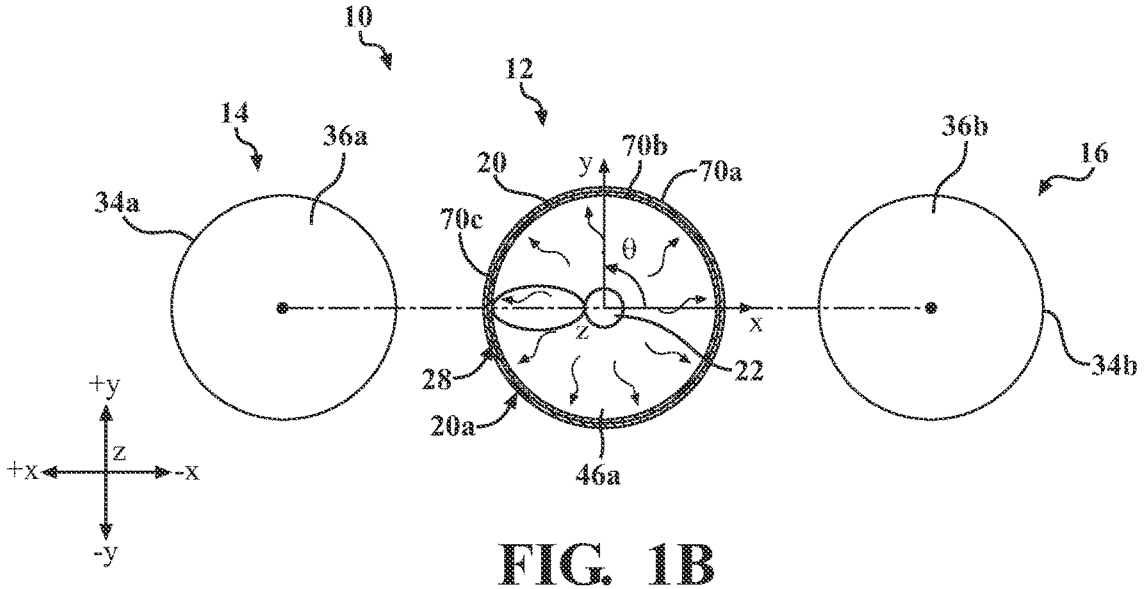
FIG. 1B schematically depicts a top down view of the heat transfer system of FIG. 1A, according to one or more embodiments shown and described herein.

Now referring to FIGS. 1A-1B, a non-limiting, example, multi-mode heat transfer system 10 is provided. In some embodiments, in an experimental setup for modeling purposes, the multi-mode heat transfer system 10 includes an emitter device 12, a first receiver device 14, and a second receiver device 16. It should be understood that any number of receiver devices may be included in the system. The first and second receiver devices 14, 16 are spaced apart defining a gap 18. The emitter device 12 is positioned in the gap 18 between the first and second receiver devices 14, 16. In some embodiments, the emitter device 12 is linearly or centrally placed or aligned with the first and second receiver devices 14, 16. That is, in some embodiments, the first receiver device 14 is positioned where $\theta=180$ degrees and the second receiver device 16 is positioned where $\theta=0$ degrees and the emitter device 12 is positioned therebetween.

In some embodiments, each of the first receiver device 14 and the second receiver device 16 is generally cylindrical in shape with an outer surface 34*a*, 34*b* respectively. In some embodiments, the cylindrical shape is formed from a solid conductive material 36*a*, 36*b*. In other embodiments, the cylindrical shape is formed from a plurality of layers. As such, the outer surface 34*a*, 34*b* of each of the receiver devices 14, 16 is generally a solid surface. In some embodiments, the solid conductive material 36*a*, 36*b* is copper. In other embodiments, the solid conductive material 36*a*, 36*b* is titanium, aluminum, silver, gold, silicon, graphite composite, and the like. In other embodiments, each of the receiver devices 14, 16 is a square shape, a flat shape, a rectangular shape, a hexagonal shape, an octagonal shape, and the like. Further, in other embodiments, the shape of each of the receiver devices 14, 16 is an irregular shape.

In some embodiments, each of the receiver devices 14, 16 are equally spaced from the emitter device 12. In a non-limiting example, each of the receiver devices 14, 16 are spaced apart 350 millimeters from the emitter device 12. It should be understood that each of the receiver devices 14, 16 may be spaced apart greater than 350 millimeter distance and/or less than the 350 millimeters distance. Further, in some embodiments, the receiver devices 14, 16 may be offset in unequal distances from the emitter device 12. For example, the first receiver device 14 may be positioned 350 millimeters from the emitter device 12 and the second receiver device 16 may be positioned 300 millimeters from the emitter device. Embodiments are not limited by the distances between the emitter device 12 and the one or more receiver devices 14, 16.

It should be appreciated that each of the receiver devices 14, 16 may extend 500 millimeters in the system vertical direction (i.e., in the +/−Z direction) from a coupling component 31*a*, 31*b* (i.e. a cooling structure, another device that can take on the heat from the emitter device 12, and the like). It should be appreciated that this is a non-limiting example and each of the receiver devices 14, 16 may extend more than or less than 500 millimeters. It should also be appreciated that each of the receiver devices 14, 16 may extend at different heights than the emitter device 12, at different heights than the other one of the receiver devices 14, 16, and the like. Further, in some embodiments, the distance between the receiver devices 14, 16 that define the gap 18 and/or the distance between each of the receiver devices 14, 16 and the emitter device 12 may be a ratio based on the height that the emitter device 12 extends in the system vertical direction (i.e., in the +/−Z direction) from a heated coupling component 30, as discussed in greater detail herein. Further, in some embodiments, each of the receiver devices 14, 16 may have a diameter of 200 millimeters. It should be appreciated that in some embodiments, the first receiver device 14 may have a greater diameter than the second receiver device 16, and vice versa. Further, in some embodiments, each of the receiver devices 14, 16 may have an equal diameter that is greater than and/or less than 200 millimeters.

Now referring to FIGS. 1A-1B and 2A-2D, in some embodiments, the emitter device 12 is generally cylindrical in shape having an inner core 22 circumferentially surrounded by an outer core 24 that includes a thickness and an outer surface 20. However, the emitter device 12 may take on any other shape. The outer surface 20 may further include a surface coating pattern 20*a*. That is, the surface coating pattern 20*a* is engineered to cover a portion or the entire outer surface 20 of the emitter device 12, as discussed in greater detail herein. In some embodiments, the outer core 24 is formed from a plurality of annular rings (FIG. 3). The outer core 24 may be formed by high thermal conductivity material inlays 26*a* and a low thermal conductivity material matrix, 26*b*, such as a carbon aerogel, and the like, which forms an anisotropic thermal conductivity within the outer core 24, as discussed in greater detail herein. Further, the high thermal conductivity material inlays 26*a* and the low thermal conductivity material matrix 26*b* may be optimized to form a composite material pattern 28, as discussed in greater detail herein. In some embodiments, the high thermal conductivity material inlays 26*a* and the low thermal conductivity material matrix 26*b* may alternate. In other embodiments, the high thermal conductivity material inlays 26*a* and the low thermal conductivity material matrix 26*b* do not alternate or are arranged in some other pattern or shape. In some embodiments, the high thermal conductivity material inlays 26*a* is copper. In other embodiments, the high thermal conductivity material inlays 26*a* may be titanium, aluminum, silver, gold, graphite composite, and the like. The high thermal conductivity material inlays 26*a* and the low thermal conductivity material matrix 26*b* may extended radially from the inner core 22, may together form the outer core 24 that circumferentially surrounds the inner core 22, and the like.

In other embodiments, the emitter device 12 is a square shape, a rectangular shape, a hexagonal shape, an octagonal shape, other uniform and non-uniform geometric shapes, and the like. Further, in other embodiments, the shape of the emitter device 12 is an irregular shape. Further, in some embodiments, regardless of the shape, the high thermal conductivity material inlays 26*a* and the low thermal conductivity material matrix 26*b* may extend radially from and/or may circumferentially surround the inner core 22 such that the inner core 22 may be positioned to extend in the system vertical direction (i.e., in the +/−Z direction) within the shape of the emitter device 12. In some embodiments, the inner core 22 is centrally positioned with respect to the outer surface 20 of the emitter device 12. In other embodiments, the inner core 22 is positioned offset to the center with respect to the outer surface 20 of the emitter device 12.

In some embodiments, the inner core 22 is a high thermal conductivity material. For instance, the inner core 22 material may be copper. In other embodiments, the inner core 22 material may be a diamond material, silver, gold, aluminum nitride, silicon carbide, aluminum, a tungsten material, graphite, zinc, a combination thereof, and the like. Further, in some embodiments, the inner core 22 is an embedded heat source such as a cartridge heater. In this embodiment, the inner core 22 may be tubular and configured to receive a heat from another component, such as an engine, a semiconductor device, and the like. In some embodiments, the diameter of the inner core 22 is 20 millimeters. In other embodiments, the diameter of the inner core 22 is greater than and/or less than 20 millimeters. The inner core 22 is thermally coupled to the composite material pattern 28 such that the heat from the inner core 22 is directed to the first receiver device 14 via the composite material pattern 28, as discussed in greater detail herein. For example, in experimentation, the inner core 22 was a 100 W heat source.

Still referring to FIGS. 1A-1B and 2A-2D, in some embodiments, the emitter device 12 may have a diameter of 200 millimeters. It should be appreciated that in some embodiments, the diameter of the emitter device 12 may be more or less than 200 millimeters. Further, it should be appreciated that in some embodiments, the emitter device 12 may have a greater diameter than the receiver devices 14, 16 and vice versa. In some embodiments, each of the receiver devices 14, 16 may have an equal diameter to the emitter device 12 and the diameter may be greater than and/or less than 200 millimeters.

The emitter device 12 may extend in the system vertical direction (i.e., in the +/−Z direction) from the heated coupling component 30 (i.e., an engine, a semiconductor device, and the like) and each of the receiver devices 14, 16 may extend 500 millimeters in the system vertical direction (i.e., in the +/−Z direction) from the coupling component 31*a*, 31*b*, as shown in FIG. 1A. It should be appreciated that the 500 millimeters is non-limiting as the emitter device 12 may extend in the system vertical direction (i.e., in the +/−Z direction) from the heated coupling component 30 more or less than 500 millimeters. It should also be understood that a height of the inner core 22 may change based on the height of the emitter device 12. It should be understood that, in some embodiments, the heated coupling component 30 is only thermally coupled to the inner core 22 and is thermally isolated from all other parts of the emitter device 12.

Further, in some embodiments, the emitter device 12 and one or both of the pair of receiver devices 14, 16 may extend in the system vertical direction (i.e., in the +/−Z direction) from the heated coupling component 30. In other embodiments, the emitter device 12 and one or both of the pair of receiver devices 14, 16 may extend in the system vertical direction (i.e., in the +/−Z direction) from either or both of the coupling components 31*a*, 31*b*. In other embodiments, it is understood that the emitter device 12 and one or both of the pair of receiver devices 14, 16 may extend in other directions besides in the vertical direction from the heated coupling component 30, from either or both of the coupling component 31*a*, 31*b*, and the like. For instance, the emitter device 12 and one or both of the pair of receiver devices 14, 16 may extend in a lateral direction (i.e., in the +/−Y direction) in the longitudinal direction (i.e., in the +/−X direction) and a combination thereof from the heated coupling component 30, from either or both of the coupling component 31*a*, 31*b*, and the like. As such, it should be appreciated that there may be a plurality of spatial relationships between the receiver devices 14, 16 and the emitter device 12.

Now referring to FIGS. 2A-2D, in some embodiments, a plurality of various emitter designs are conceivable. In some embodiments, the various emitter designs include a baseline case in which the emitter body is either all copper or all carbon aerogel, as shown in the emitter device 12' of FIG. 2A. It is understood that the emitter device 12' is identical to the emitter device 12 with the exceptions of the features described herein. As such, like features will use the same reference numerals with a suffix "'" for the reference numbers. As such, for brevity reasons, these features will not be described again. It should be understood that the emitter device 12' is generally cylindrical in shape having an inner core 22' circumferentially surrounded by an outer core 24' that includes a thickness and an outer surface 20'. The outer core 24' is a solid body construction. The outer surface 20' is coated by a surface coating pattern 20*a*', which includes a first coating material 70*a*' that circumferentially surrounds the outer surface 20'. A second coating material 70*b*' circumferentially surrounds and coats the first coating material 70*a*'. The surface coating pattern 20*a*' are optimized to control directional radiosity as a function of a temperature of the emitter device 12', as discussed in greater detail herein.

Referring to FIGS. 1A-1B, 2B-2D and 3, a portion of the outer surface 20 includes the composite material pattern 28. The composite material pattern 28 may extend a length of the emitter device 12 in a system vertical direction (i.e., in the +/−Z direction). The composite material pattern 28 is thermally coupled to the inner core 22 of the emitter device 12. Further, the composite material pattern 28 may be configured to direct the heat from the inner core 22 to the first receiver device 14 without directing heat, or significantly less heat, to the second receiver device 16. That is, the composite material pattern 28 is configured to assist in directing or focusing heat as radiated heat from the inner core 22 to the first receiver device 14 and limit the amount of radiated het directed to the second receiver device 16.

In some embodiments, the first receiver device 14 and the second receiver device 16 are each positioned in an area that is configured to receive heat. For example, in aerospace applications, one component, such as a sail may be coupled to another component (e.g., a fly-by-light sailcraft) that may need, or works more efficient, when receiving additional heat and associated directed radiated power. As such, the one component may be coupled to the first receiver device 14 such that the emitter device 12 may direct radiated heat to the first receiver device 14 in order to provide heat to the coupled component to expel a high temperature heat from the emitter device 12 and/or the emitter device 12 may expel a low temperature heat from the emitter device 12 to both the first receiver device 14 and the second receiver device 16. In another example, heat generated from a hot body engine may be captured by the inner core 22 and then transferred, in a focused manner, to the first receiver device 14 such that unwanted high temperature heat from the hot body engine may be transferred to another area within the vehicle and/or transferred to both the first receiver device 14 and the second receiver device 16 such that unwanted lower temperature heat from the hot body engine may be transferred to another area within the vehicle. In other embodiments, the heat radiated from the emitter device 12 is forced into ambient air. For example, heat from the engine hot body may be directed, by the composite material pattern 28 and the surface coating pattern 20*a* of the emitter device 12, to an object positioned in an area of an engine compartment in which air is directed out of the engine compartment when the temperature is above a threshold temperature, as discussed in greater detail herein. Additionally, it should be appreciated that heat from the engine hot body may be directed, by the surface coating pattern 20*a* of the emitter device 12, to a pair of objects (e.g., the first and second receiver devices 14, 16) object positioned in an area of an engine compartment in which air is directed out of the engine compartment when the temperature is below the threshold temperature, as discussed in greater detail herein.

The composite material pattern 28 may be a plurality of shapes. As such, it should be appreciated that the composite material pattern 28 may be optimized for each specific application. In some embodiments, the composite material pattern 28 includes a plurality of uniform shapes. In other embodiments, the composite material pattern 28 includes irregular shapes. In other embodiments, the composite material pattern 28 includes both uniform and irregular shapes.

The surface coating pattern 20*a* may include a plurality of coating materials, or layers, that are optimized to control directional radiosity as a function of a temperature of the emitter device 12. That is, the emitter device 12 controls radiative heat emitted from an object by using a strategically designed switchable surface coating pattern 20*a*. The switch action permits the emitter device 12 to be heated to a high temperature state to focus radiation toward a specific spatial direction (e.g., the first receiver device 14) using the composite material pattern 28, or the temperature of the emitter device 12 may be kept lower resulting in more omnidirectional radiation from the emitter device to other objects (e.g., both the first and second receiver devices 14, 16). As such, a temperature dependent surface coating distribution is utilized that switches an emissivity of the emitter device 12 between a low state emissivity and a high state emissivity, thereby controlling the heating and cooling of objects (e.g., both the first and second receiver devices 14, 16) separated some distance from the emitter device.

In some embodiments, the surface coating pattern 20*a* is spun or coated on the outer surface 20 of the emitter device 12 and permits that emitter device 12 to change between a low emissivity state and a high emissivity state based on a surface temperature of the emitter device 12. That is, in one application, when the heat of the emitter device 12 is above a predetermined threshold, the surface coating pattern 20*a* may act as a switch to activate, or switch on, a coating material that activates the composite material pattern 28 to focus the radiated heat towards, for example, the first receiver device 14, as discussed in greater detail herein. Alternatively, in a different application, when the heat of the emitter device 12 is below a predetermined threshold, the surface coating pattern 20*a* may act as a switch to activate, or switch off, the coating material that activates the composite material pattern 28 thereby activating a different coating material that permits radiated heat to be dispersed between the first receiver device 14 and the second receiver device 16, as discussed in greater detail herein.

The surface coating pattern 20*a* may include a first coating material 70*a*, a second coating material 70*b* and a third coating material 70*c*, that are all different from one another. The first coating material 70*a* circumferentially covers at least portions of the outer surface 20 of the emitter device 12. Further, the first coating material 70*a* may be the outermost layer of the surface coating pattern 20*a* with respect to the inner core 22. That is, the first coating material 70*a* may be the layer of the plurality of layers that is exposed to the elements of the environment where the emitter device 12 positioned. The second and third coating materials 70*b*, 70*c* are positioned to be covered by the first coating material 70*a*. The second coating material 70*b* covers portions of the outer surface 20 of the emitter device 12 and may not cover the composite material pattern 28. The second coating material 70*b* is activated when the surface temperature of the outer surface of the emitter device 12 is below the predetermined temperature threshold. The third coating material 70*c* covers only the composite material pattern 28 of the outer surface 20 of the emitter device 12 and is activated when the surface temperature of the outer surface 20 of the emitter device 12 is above the predetermined temperature threshold. Therefore, the surface coating pattern 20*a* permits the emitter device 12 to have a switchable radiosity as a function of temperature such that, in the low emissivity state, the emitter device 12 transmits an omni-directional radiation and, in the high emissivity state, the emitter device 12 transmits a focused radiation via the composite material pattern 28.

Now referring to FIG. 2B, a first aspect of a composite material pattern 28 and the surface coating pattern 20*a* of the emitter device 12 will be described in greater detail. In this aspect, the composite material pattern 28 may include a circular portion 52 that surrounds the inner core 22. The composite material pattern 28 may further include a plurality of segments 54 that extend radially outward from half of the circular portion 52 such that the composite material pattern 28 is a semi-circular arrangement 55 that transverses the outer core 24 (i.e., extends a length of the outer surface 20 of the outer core 24 of the emitter device 12 in the system vertical direction (i.e., in the +/−Z direction)). As such, two of the plurality of segments 54 may extend about the axis A2 to form the ending/starting position of the composite material pattern 28. In this embodiment, a plurality of outer curved segments 56 form the outer portion 50 of the emitter device 12 by surrounding the remaining portions of the inner core 22. In some embodiments, at least a portion of the plurality of outer curved segments 56 are transverse to the composite material pattern 28. That is, two of the plurality of segments 54 may extend at 90 degrees and 270 degrees such that the two segments of the plurality of segments 54 intersect with a portion of the plurality of outer curved segments 56.

It should be appreciated, that in some embodiments, the composite material pattern 28 spans θ=—90° to θ=90° nearest to the second receiver device 16 with the composite material pattern 28 focusing the high thermal conductivity material inlays 26*a* directed towards the first receiver device 14. In some embodiments, the high thermal conductivity material inlays 26*a* are 2 millimeters thick at a 3 millimeter spacing in the composite material pattern 28. It should be understood that the high thermal conductivity material inlays 26*a* may be less than or more than 2 millimeters thick at less than or more than 3 millimeter spacing in the composite material pattern 128.

Still referring to FIG. 2B, the surface coating pattern 20*a* includes the first coating material 70*a*, the second coating material 70*b* and the third coating material 70*c*. The first coating material 70*a* circumferentially surrounds the outer surface 20 of the emitter device 12 and is the outermost layer with respect to the inner core 22 of the emitter device 12. The second coating material 70*b* circumferentially covers portions of the outer surface 20 of the emitter device 12 and is the covered by the first coating material 70*a*. In some embodiments, the second coating material 70*b* may also cover at least portions of the high thermal conductivity material inlays 26*a* and/or the low thermal conductivity material matrix 26*b* of the composite material pattern 28. In other embodiments, the second coating material 70*b* may not cover or coat portions of the high thermal conductivity material inlays 26*a* and/or the low thermal conductivity material matrix, 26*b* of the composite material pattern 28. The third coating pattern 70*c* may only cover or coat the high thermal conductivity material inlays 26*a* and/or the low thermal conductivity material matrix, 26*b* of the composite material pattern 28. In some embodiments, the third coating pattern 70*c* may only cover or coat portions of the high thermal conductivity material inlays 26*a* and/or portions of the low thermal conductivity material matrix, 26*b* of the composite material pattern 28. In other embodiments, the third coating pattern 70*c* may cover or coat the entire high thermal conductivity material inlays 26*a* and/or the entire low thermal conductivity material matrix, 26*b* of the composite material pattern 28.

It should be understood that the second coating material 70*b* is activated, or used, when the surface temperature of the outer surface 20 of the emitter device 12 is below the predetermined temperature threshold. That is, the second coating material 70*b* may function or be used as a normally closed switched such that this is the default setting of the emitter device 12. The third coating material 70*c* is activated, or switched on, when the surface temperature of the outer surface 20 of the emitter device 12 is above the predetermined temperature threshold. As such, when the second coating material 70*b* is activated, the emitter device 12 transmits an omni-directional radiation (e.g., 180 degrees) following, or consistent with the placement or coating of the first coating material 70*a* and the second coating material 70*b*. When the third coating material 70*c* is activated, the high thermal conductivity material inlays 26*a* of the composite material pattern 28 are utilized to transmit the focused radiation via the composite material pattern 28. That is, depending on a temperature, either the second coating material 70*b* or the third coating material 70*c* is used.

Still referring to FIG. 2B, it should be appreciated that the composite material pattern 28 is optimized for heat and/or power transfer between the emitter device 12 and the first receiver device 14 via the composite material pattern 28 while limiting the heat and/or power transfer to the second receiver device 16. Further, it should be appreciated that the surface coating pattern 220*a* is optimized to control directional radiosity as a function of a temperature of the emitter device 12. As such, the surface coating pattern 20*a* functions as a switch for the emitter device 12 that allows or permits the composite material pattern 28 to function, as described herein, when the temperature of the emitter device 12 exceeds the predetermined temperature threshold, which activates or switches on, the third coating material 70*c* of the surface coating pattern 20*a* to utilize the composite material pattern 28 for a focused power and/or heat transfer from the emitter device 12.

In response, the composite material pattern 28 generates the outer core anisotropic material thermal conductivity that is optimized for power transfer from the emitter device 12 to the first receiver device 14. That is, the composite material pattern 28 is an optimized composite material structure of the emitter device 12 to maximize power transfer via heat transfer from the emitter device 12 to the first receiver device 14 while limiting the power transfer to the second receiver device 16. As such, the composite material pattern 28 of the emitter device 12 may be a power transfer system that takes heat from the emitter device 12 and directs it to an area where the heat may be beneficial and/or may not cause harm.

It should be understood that the predetermined temperature threshold may be determined and set based a plurality of factors including the specific application, the type of composite material pattern, the size of the emitter device 12, the spacing between the emitter device 12 and the first receiver device 14 and the second receiver device 16, and the like. Therefore, the predetermined temperature threshold may be a dynamic range.

Figure 2C:
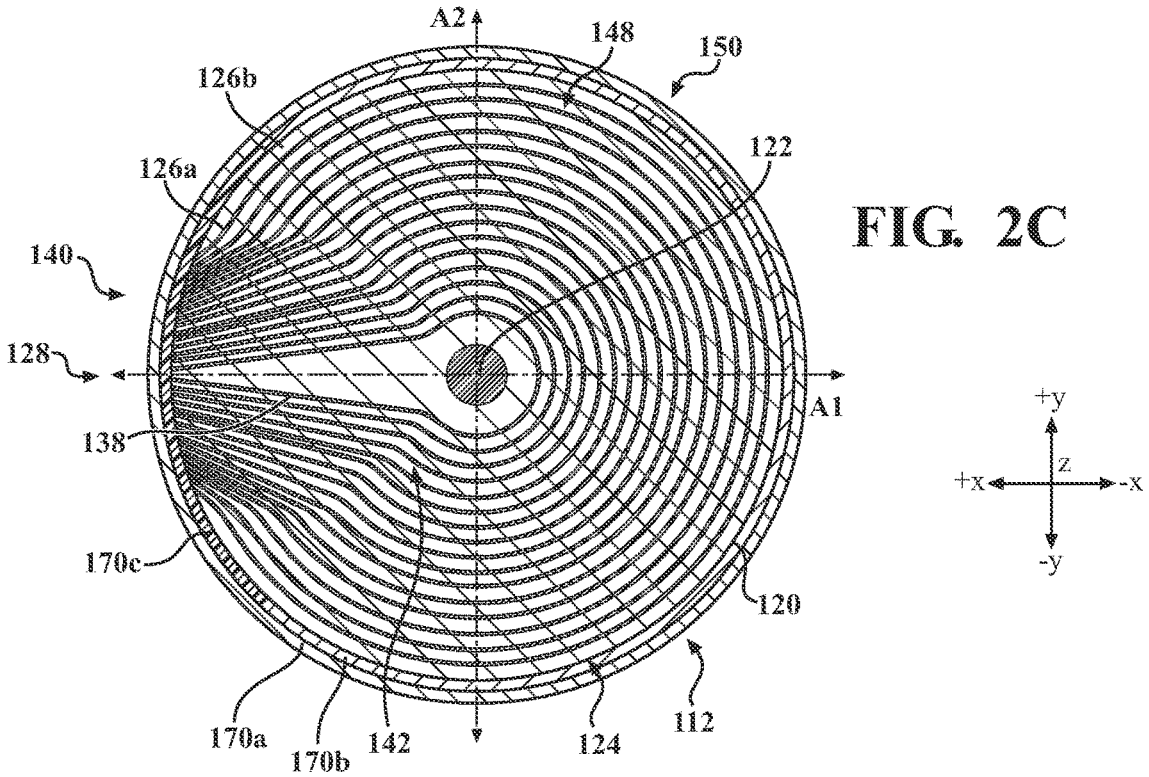
FIG. 2C schematically depicts a cross-sectional view of a second aspect of a composite material pattern of the emitter device of the heat transfer system of FIG. 1A taken from line 2-2, according to one or more embodiments shown and described herein.
Figure 3:
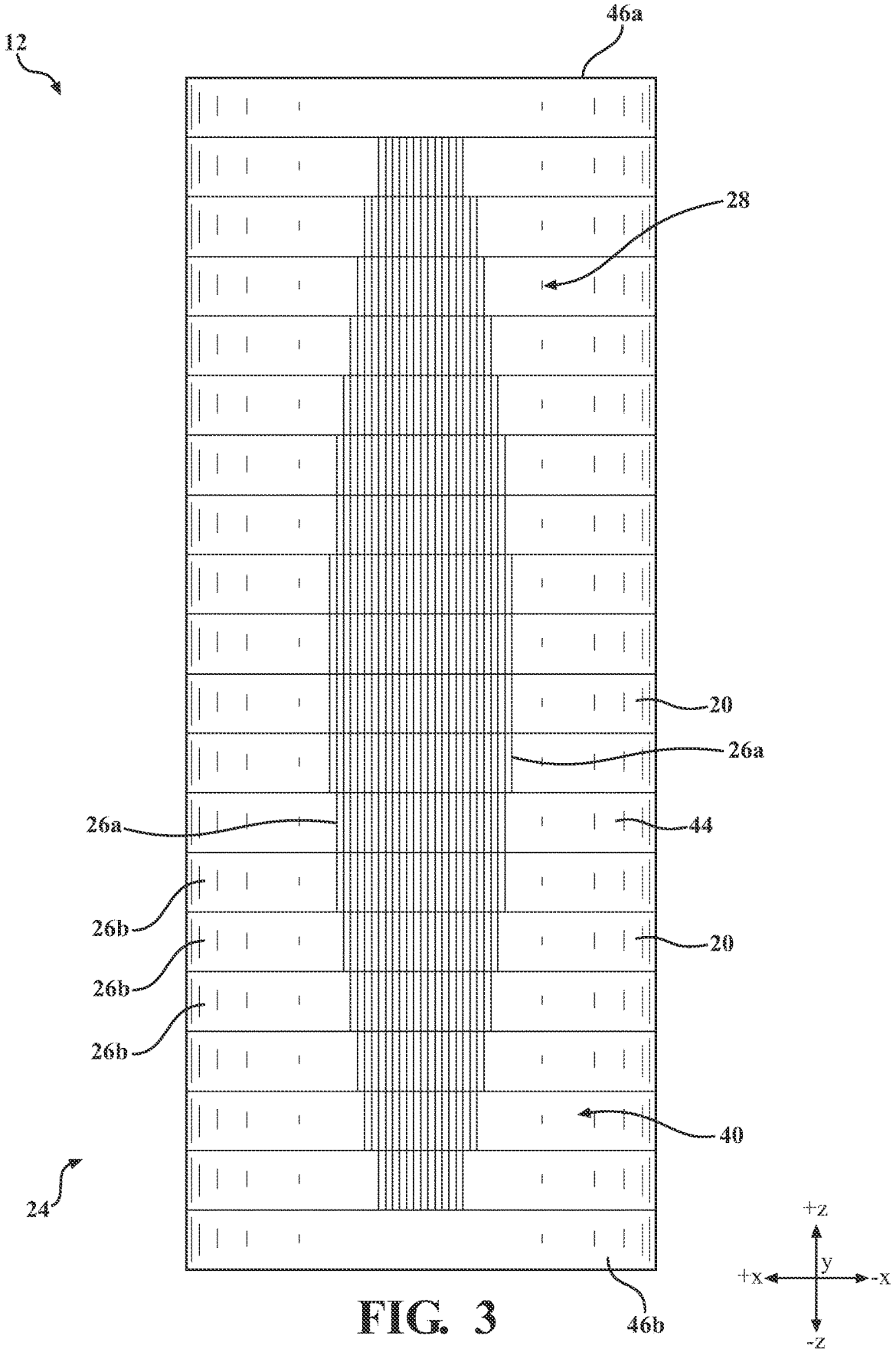
FIG. 3 schematically depicts an isolated front view of the first aspect of the composite material pattern of the emitter device of FIG. 2C, according to one or more embodiments shown and described herein.

Now referring to FIG. 2C and FIG. 3, another example of a composite material pattern 128 and the surface coating pattern 120*a* of the emitter device 112 is schematically depicted. It is understood that the emitter device 112 is identical to the emitter device 12 with the exceptions of the features described herein. As such, like features will use the same reference numerals with a prefix "1" for the reference numbers. As such, for brevity reasons, these features will not be described again.

In the second aspect, the composite material pattern 128 includes a teardrop region 138 that surrounds the inner core 122. The teardrop region 138 is centered around an axis A1 and extends in the longitudinal direction (i.e., in the +/−X direction) from one side of the inner core 122. The composite material pattern 128 further includes a plurality of linear segments 140 extending vertically from an apex 142 of the teardrop region 138 and extend a length of the outer surface 120 of the emitter device 112 in the system vertical direction (i.e., in the +/−Z direction) to transverse the outer core 124, illustrated as the plurality of annular rings.

That is, it should be appreciated that in embodiments in which the outer core 124 is the plurality of annular rings, the plurality of annular rings are stacked on one another to form a column, as best seen in FIG. 3. The outer core 124 includes the high thermal conductivity material inlays 126*a* and the low thermal conductivity material matrix 126*b*, such as carbon aerogel. That is, the high thermal conductivity material inlays 126*a* may be inlayed into the low thermal conductivity material matrix 116*b* to form the composite material pattern 128 and the combination may form the outer core 124. In some embodiments, the emitter device 112 may be a copper/carbon aerogel anisotropic composite. The high thermal conductivity material inlays 126*a* are implemented from θ=90° to θ=270° based on the geometric location of the first receiver device 14. In this embodiment, the high thermal conductivity material inlays 126*a* are 1 millimeter thick at a 4 millimeter spacing in the composite material pattern 128. It should be understood that the high thermal conductivity material inlays 126*a* may be less than or more than 1 millimeter thick and at less than or more than 4 millimeter spacing in the composite material pattern 128.

Still referring to FIG. 2C and FIG. 3, it should be appreciated that when the plurality of annular rings are stacked, the high thermal conductivity material inlays 126*a* and the low thermal conductivity material matrix 126*b* may align with the high thermal conductivity material inlays 126*a* and the low thermal conductivity material matrix 126*b* of an adjacent annular ring to form the composite material pattern 128. As such, it should be appreciated that the composite material pattern 128 in FIG. 3 is viewed from the axis A1 extending in the —X direction such that the view is looking from the outside towards the —X direction. Further, it should be understood that the outer core 124 has a thickness so to circumferentially surround the inner core 122. Further, it should be understood that the outer core 24 may be a monolithic structure.

A plurality of linear segments 140 of the composite material pattern 128 extend vertically along a portion of the outer surface 120 and into at least a portion of the thickness of the emitter device 112. In some embodiments, the plurality of linear segments 140 curve inward towards the inner core 122 at the apex 142 of the teardrop region 138. In some embodiments, the composite material pattern 128 is uniform along the length of the outer surface of the emitter device 112 in the system vertical direction (i.e., in the +/−Z direction). In other embodiments, the composite material pattern 128 includes a widening pattern in the system lateral direction (i.e., in the +/−Y direction) such that the widest portion of the composite material pattern 128 is near a center 144 of the outer surface 120 of the emitter device 112. That is, the composite material pattern 128 is narrower in width at ends 146*a*, 146*b* than at the center 144.

Further, in some embodiments, the composite material pattern 128 transverses the outer core 124 (i.e., extends the entire length of the outer surface 120 of the outer core 124 of the emitter device 112 in the system vertical direction (i.e., in the +/−Z direction)). In other embodiments, as best seen in FIG. 3, the composite material pattern 128 begins and/or terminates before one or both ends 146*a*, 146*b* of the emitter device 112. A plurality of outer curved segments 148 form an outer portion 150 of the emitter device 112 by surrounding the remaining portions of the inner core 122 and the teardrop region 138. In some embodiments, at least a portion of the plurality of outer curved segments 148 are transverse to the composite material pattern 128. Further, the composite material pattern 128 may be narrower in areas in the system longitudinal direction (i.e., in the +/−X direction) than in other areas. It should be appreciated that this composite material pattern 128 creates an outer core anisotropic thermal conductivity that reduces the amount of heat and/or power transfer to the second receiver device 116 while increasing the amount of heat and/or power transfer to the first receiver device 114, as discussed in greater detail herein.

Still referring to FIGS. 2C and 3, the surface coating pattern 120*a* includes the first coating material 170*a*, the second coating material 170*b* and the third coating material 170*c*. The first coating material 170*a* circumferentially surrounds the outer surface 120 of the emitter device 112 and is the outermost layer with respect to the inner core 122 of the emitter device 112. The second coating material 170*b* circumferentially surrounds the outer surface 120 of the emitter device 112 and is the covered by the first coating material 170*a*. The second coating material 170*b* covers portions of the outer surface 120 of the emitter device 212 other than the composite material pattern 228. In some embodiments, the second coating material 170*b* may also cover at least portions of the high thermal conductivity material inlays 126*a* and/or the low thermal conductivity material matrix 126*b* of the composite material pattern 128. In other embodiments, the second coating material 170*b* may not cover or coat portions of the high thermal conductivity material inlays 126*a* and/or the low thermal conductivity material matrix, 126*b* of the composite material pattern 128.

The third coating material 170*c* may only cover or coat the high thermal conductivity material inlays 126*a* and/or the low thermal conductivity material matrix, 126*b* of the composite material pattern 128. In some embodiments, the third coating material 170*c* may only cover or coat portions of the high thermal conductivity material inlays 126*a* and/or portions of the low thermal conductivity material matrix, 126*b* of the composite material pattern 128. In other embodiments, the third coating material 170*c* may cover or coat the entire high thermal conductivity material inlays 126*a* and/or the entire low thermal conductivity material matrix, 126*b* of the composite material pattern 128.

It should be understood that the second coating material 170*b* is used when the surface temperature of the outer surface 120 of the emitter device 112 is below the predetermined temperature threshold. That is, the second coating material 170*b* may function or be used as a normally closed switched such that this is the default setting of the emitter device 112. The third coating material 170*c* is activated, or switched on, when the surface temperature of the outer surface 120 of the emitter device 112 is above the predetermined temperature threshold.

As such, when the second coating material 170*b* is activated, the emitter device 112 transmits an omni-directional radiation (e.g., 180 degrees) following, or consistent with the placement or coating of the first coating material 170*a* and the second coating material 170*b*. When the third coating material 170*c* is activated, the high thermal conductivity material inlays 126*a* of the composite material pattern 128 are utilized to transmit the focused radiation via the composite material pattern 128. That is, depending on a temperature, either the second coating material 170*b* or the third coating material 170*c* is used.

It should be appreciated that the composite material pattern 128 is optimized for heat and/or power transfer between the emitter device 112 and the first receiver device 14 via the composite material pattern 128 while limiting the heat and/or power transfer to the second receiver device 16. Further, it should be appreciated that the surface coating pattern 120*a* is optimized to control directional radiosity as a function of a temperature of the emitter device 112. As such, the surface coating pattern 120*a* functions as a switch for the emitter device 112 that allows or permits the composite material pattern 128 to function, as described herein, when the temperature of the emitter device 112 exceeds the predetermined temperature threshold, which activates or switches on, the third coating material 170*c* of the surface coating pattern 120*a* to utilize the composite material pattern 128 for a focused power and/or heat transfer from the emitter device 112.

In response, the composite material pattern 128 generates the outer core anisotropic material thermal conductivity that is optimized for power transfer from the emitter device 112 to the first receiver device 14. That is, the composite material pattern 128 is an optimized composite material structure of the emitter device 112 to maximize power transfer via heat transfer from the emitter device 112 to the first receiver device 14 while limiting the power transfer to the second receiver device 16. As such, the composite material pattern 128 of the emitter device 112 may be a power transfer system that takes a heat from the emitter device 112 and directs the heat to an area where the heat may be beneficial and/or may not cause harm.

Figure 2D:
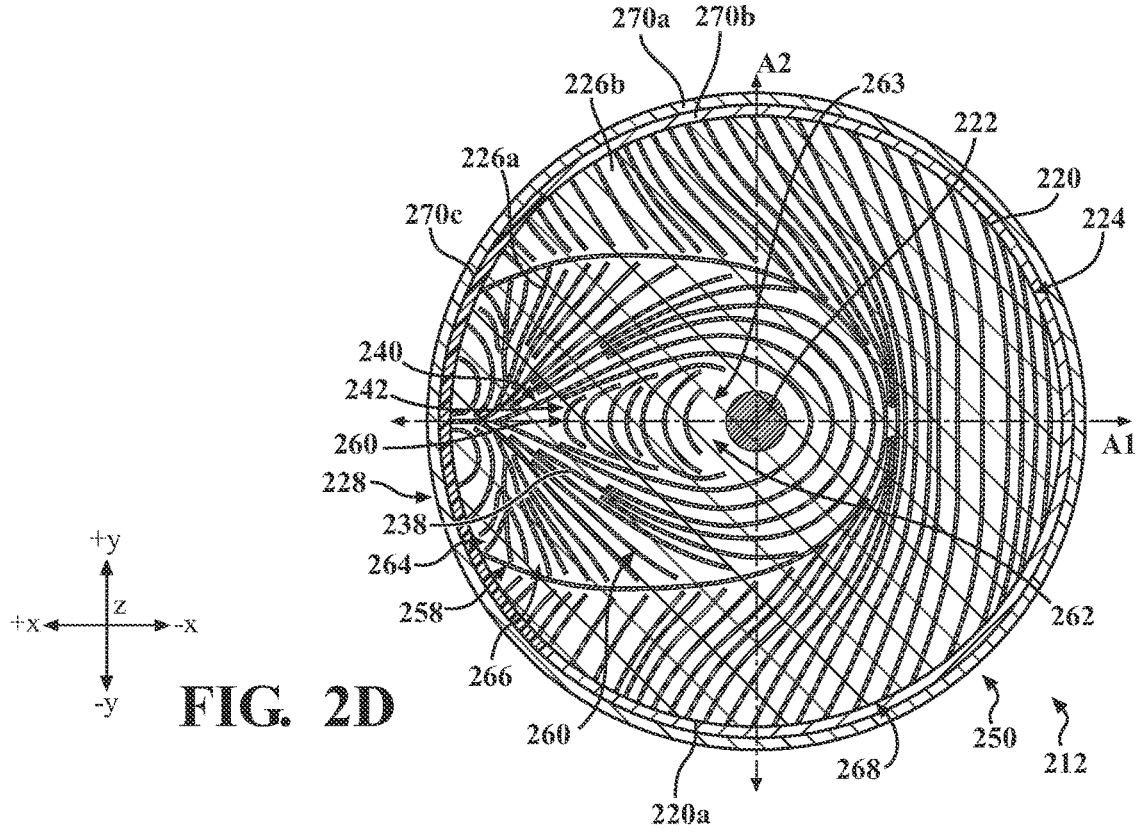
FIG. 2D schematically depicts a cross-sectional view of a third aspect of a composite material pattern of the emitter device of the heat transfer system of FIG. 1A taken from line 2-2, according to one or more embodiments shown and described herein.

Now referring to FIG. 2D, another non-limiting example of a composite material pattern 228 and the surface coating pattern 220*a* of the emitter device 212 is schematically depicted. It should be understood that the emitter device 212 is identical to the emitter device 12 with the exceptions of the features described herein. As such, like features will use the same reference numerals with a prefix "2" for the reference numbers. As such, for brevity reasons, these features will not be described again. It should be appreciated that the emitter device 212 may be a copper/carbon aerogel metamaterial composite in which the composite material pattern 228 is found using a gradient-based homogenization design optimization technique to locally configure the anisotropic material thermal conductivity layout of the emitter device 212 in combination with the exterior surface emissivity profile of the outer surface 220, as discussed in greater detail herein.

Further, it should be appreciated that, in some embodiments, the composite material pattern 228 spans $\theta=-90°$ to $\theta=90°$ nearest to the second receiver device 16 with the composite material pattern 128 focusing the high thermal conductivity material inlays 126*a* directed towards the first receiver device 14. In some embodiments, the high thermal conductivity material inlays 126*a* are less than 1 millimeter thick at a variable millimeter spacing throughout the composite material pattern 128. It should be understood that the high thermal conductivity material inlays 126*a* may be more than 1 millimeter thick and the variable millimeter spacing may be uniform and/or non-uniform as described herein with respect to the composite material pattern 228.

The composite material pattern 228 includes the teardrop region 238 that surrounds the inner core 222 and also includes the plurality of linear segments 240 extending vertically from the apex 242 of the teardrop region 238. Further, the plurality of linear segments 240 extend a length of the outer surface 220 of the emitter device 212 in the system vertical direction (i.e., in the +/−Z direction) to transverse the outer core 24 (i.e., extends the length of the outer surface 20 of the outer core 24 of the emitter device 12 in the system vertical direction (i.e., in the +/−Z direction)). In this embodiment, the composite material pattern 228 further includes a flux field region 258. The teardrop region 238 of the composite material pattern 228 is positioned within the flux field region 258.

Still referring to FIG. 2D, a plurality of curved segments 260 surround the inner core 222 and are positioned within and outside of the teardrop region 238. Further, a plurality of partial ellipses segments 262 and a plurality of semi-circular segments 263 are positioned within the teardrop region 238. In some embodiments, the plurality of partial ellipses segments 262 and/or the plurality of semi-circular segments 263 are positioned to be centered in the system longitudinal direction (i.e., in the +/−X direction) with respect to the inner core 222. Further, in some embodiments, the further away the plurality of partial ellipses segments 262 and the plurality of semi-circular segments 263 from the inner core the smaller the radius. A plurality of curvilinear segments 264 and a plurality of non-linear segments 266 that form a portion of the composite material pattern 228 are positioned within the flux field region 258 but not within the teardrop region 238. In some embodiments, it should be appreciated that the plurality of curved segments 260, the plurality of partial ellipses segments 262, the plurality of semi-circular segments 263, the plurality of curvilinear segments 264 and/or the plurality of non-linear segments 266 that form a portion of the composite material pattern 228 are curved towards and/or about the axis A1.

A plurality of outer nonlinear segments 268 surround the flux field region 258 such that the plurality of outer nonlinear segments 268 form the outer portion 250 of the emitter device 212 that surround the remaining portion of the inner core 222. In some embodiments, at least a portion of the plurality of outer nonlinear segments 268 are transverse to the composite material pattern 228.

Still referring to FIG. 2D, the surface coating pattern 220*a* includes the first coating material 270*a*, the second coating material 270*b* and the third coating material 270*c*. The first coating material 270*a* circumferentially surrounds the outer surface 220 of the emitter device 212 and is the outermost layer with respect to the inner core 222 of the emitter device 212. The second coating material 270*b* circumferentially surrounds the outer surface 220 of the emitter device 212 and is the covered by the first coating material 270*a*. The second coating material 270*b* generally coats portions of the outer surface 220 of the emitter device 212 except the composite material pattern 228. In some embodiments, the second coating material 270*b* may also cover at least portions of the high thermal conductivity material inlays 226*a* and/or the low thermal conductivity material matrix 226*b* of the composite material pattern 228. In other embodiments, the second coating material 270*b* may not cover or coat portions of the high thermal conductivity material inlays 226*a* and/or the low thermal conductivity material matrix, 226*b* of the composite material pattern 228.

The third coating material 270*c* may only cover or coat the high thermal conductivity material inlays 226*a* and/or the low thermal conductivity material matrix, 226*b* of the composite material pattern 228. In some embodiments, the third coating material 270*c* may only cover or coat portions of the high thermal conductivity material inlays 226*a* and/or portions of the low thermal conductivity material matrix, 226*b* of the composite material pattern 228. In other embodiments, the third coating material 270*c* may cover or coat the entire high thermal conductivity material inlays 226*a* and/or the entire low thermal conductivity material matrix, 226*b* of the composite material pattern 228.

It should be understood that the second coating material 270*b* is used when the surface temperature of the outer surface 220 of the emitter device 212 is below the predetermined temperature threshold. That is, the second coating material 270*b* may function or be used as a normally closed switched such that this is the default setting of the emitter device 212. The third coating material 270*c* is activated, or switched on, when the surface temperature of the outer surface 220 of the emitter device 212 is above the predetermined temperature threshold.

As such, when the second coating material 270*b* is activated, the emitter device 212 transmits an omni-directional radiation (e.g., 180 degrees) following, or consistent with the placement or coating of the first coating material 270*a* and the second coating material 270*b*. When the third coating material 270*c* is activated, the high thermal conductivity material inlays 226*a* of the composite material pattern 228 are utilized to transmit the focused radiation via the composite material pattern 228. That is, depending on a temperature, either the second coating material 270*b* or the third coating material 270*c* is used.

Still referring to FIG. 2D, it should be appreciated that the composite material pattern 228 is optimized for heat and/or power transfer between the emitter device 212 and the first receiver device 14 via the composite material pattern 228 while limiting the heat and/or power transfer to the second receiver device 16. Further, it should be appreciated that the surface coating pattern 220*a* is optimized to control directional radiosity as a function of a temperature of the emitter device 212. As such, the surface coating pattern 220*a* functions as a switch for the emitter device 212 that allows or permits the composite material pattern 228 to function, as described herein, when the temperature of the emitter device 212 exceeds the predetermined temperature threshold, which activates or switches on, the third coating material 270*c* of the surface coating pattern 220*a* to utilize the composite material pattern 228 for a focused power and/or heat transfer from the emitter device 212.

In response, the composite material pattern 228 generates the outer core anisotropic material thermal conductivity that is optimized for power transfer from the emitter device 212 to the first receiver device 14. That is, the composite material pattern 228 is an optimized composite material structure of the emitter device 212 to maximize power transfer via heat transfer from the emitter device 212 to the first receiver device 14 while limiting the power transfer to the second receiver device 16. As such, the composite material pattern 228 of the emitter device 212 may be a power transfer system that takes a heat from the emitter device 212 and directs the heat to an area where the heat may be beneficial and/or may not cause harm.

It should now be understood that while the composite material pattern 228 is optimized for heat and/or power transfer, composite material pattern 28, 128, 228 work in conjunction with an optimized emissivity distribution profile, that in some embodiments, is the surface coating pattern 20*a*, 120*a*, 220*a* on the outer surface 20, 120, 220 of the emitter device 12, 112, 212 respectively, for heat and/or power transfer, as discussed in greater detail herein. The surface coating pattern 20*a*, 120*a*, 220*a* switches the emitter device 12 between the multi-mode (e.g., different emissivity profiles) to transfer radiant heat and/or power from the emitter device 12 to the first receiver device 14 and the second receiver device 16, as discussed in greater detail herein.

It should also be appreciated that the any composite material pattern 28, 128, 228 and/or the surface coating pattern 20*a*, 120*a*, 220*a* may each be changed or altered to maximize the heat and/or power transfer to the first receiver device 14 and/or the second receiver device 16. In some embodiments, the composite material pattern 28, 128, 228 and/or the surface coating pattern 20*a*, 120*a*, 220*a* may change based on the distance between the emitter device 12 and the receiver devices 14, 16. Further, the composite material pattern 28, 128, 228 and/or the surface coating pattern 20*a*, 120*a*, 220*a* may change based on the type of material used in the emitter device 12.

Further, in some embodiments, the surface coating pattern 20*a*, 120*a*, 220*a* may include a layer of vanadium dioxide ($VO_2$). Examples of $VO_2$ films that may be deposited on various substrates, include, without limitation, silicon (Si), quartz, and polished mirror-like aluminum (Al), and the like. It should be understood that $VO_2$ undergoes a reversible phase transition from a low-temperature monoclinic $VO_2$ (M1) semi-conductive phase to a high-temperature tetragonal $VO_2$(R) metallic phase at a transition temperature ($T_{tr}$). In some embodiments, the transition temperature ($T_{tr}$) is dependent on the material used for the emitter device 12. For example, in some embodiments, the transition temperature (TO of the emitter device 12 may be between 20 degrees Celsius to 70 degrees Celsius for the surface coating pattern 20*a*, 120*a*, 220*a* to remain in the low emissivity state (e.g., with the radiated heat dispersed omni-directional) and a minimum temperature of 50 degrees Celsius for the surface coating pattern 20*a*, 120*a*, 220*a* to switch to the high emissivity state. It should be appreciated that these are non-limiting examples of temperatures and/or temperature ranges and that these temperatures may change or vary based on various parameters, such as, without limitation, future material and surface coating discoveries.

Further, each coating material 70*a*, 70*b*, 70*c* may have its own individual emissivity profile as a function of temperature. As such, each of the coating materials 70*a*, 70*b*, 70*c* of the surface coating pattern 20*a* function as a switch to activate or shield heat and/or power transmission from the emitter devices 12, 112, 212 to the first and second receiver devices 14, 16.

It should also be appreciated that, in embodiments, the optimization of the emitter device 12, 112, 212 described herein is an angularly varying emitter surface emissivity, and is specified to optimize far-field thermal emission through the use of engineered emissivity outer surface pattern 20*a*, 120*a*, 220*a*, on the outer surface 20 of the emitter device 12. The optimization objective function, $f_o$, is defined by an integral objective on the boundary of the first receiver device 14, $\Gamma_{R1}$, as the product of the surface irradiation of the first receiver device, $G_{R1}$, and the angularly dependent view factor due to the spatial configuration of the emitter device 12, 112, 212 and the first receiver device 14, $F_{e-R1}=1-F_{amb}(\varphi)$, as $$f_o=\int G_{R1}[1-F_{amb}(\varphi)]d\Gamma_{R1}.$$

where the ambient view factor, $F_{amb}$, is evaluated on the outer surface 34*a* of the first receiver device 14 based on the local angular position, φ, defined by the $(x_2,y_2,z_2)$ coordinate system (not shown) with origin coincident with the axial center of the first receiver device 14. The advantage of the optimization scheme, as described herein, is that it is highly adaptable to more complex scenes involving arbitrary, non-regular geometries with arbitrarily positioned receiver devices 14, 16.

With reference now to FIGS. 1-3, in some embodiments, the emitter devices 12, 112, 212 may be patterned or manufactured by a three-dimensional printer using techniques known to those skilled in the art. That is, the composite material pattern 28, 128, 228, the surface coating pattern 20*a*, 120*a*, 220*a*, the alternating materials of the outer core 24, and the like, may be each be manufactured by a three-dimensional printer, an additive fabrication method, and the like. Further, in some embodiments, the emitter devices 12, 112, 212, may be formed from multiple stacked molds to cast the low thermal conductivity material matrix 26*b*, 126*b*, 226*b* into the molds and the high thermal conductivity material inlays 26*a*, 126*a*, 226*a* are inlayed into the low thermal conductivity material matrix 26*b*, 126*b*, 226*b* to form the composite material pattern 28, 128, 228. It should be appreciated that there may be more ways to form the emitter devices 12, 112, 212, and/or the composite material pattern 28, 128, 228, and is not limited to those described herein.

The surface coating pattern 20*a*, 120*a*, 220*a*, may coat, or be spun onto the emitter device. A first thermochromic material, such as aluminum, quartz, $VO_2$, tungsten, chromium oxide, other thermochromic materials, and/or the like is spun onto the emitter device 12, 112, 212 while a portion of the emitter device is masked off to prevent the first material from being spun onto those locations. A second thermochromic material is then spun onto the previously masked area of the emitter device such that the emitter device 12, 112, 212 is now circumferentially coated between the different materials. A third thermochromic material is then spun onto the emitter device 12, 112, 212 that covers both the first and second thermochromic materials. It should be appreciated that there may be more ways to form the surface coating pattern 20*a*, 120*a*, 220*a*, and is not limited to those described herein.

Figure 4:
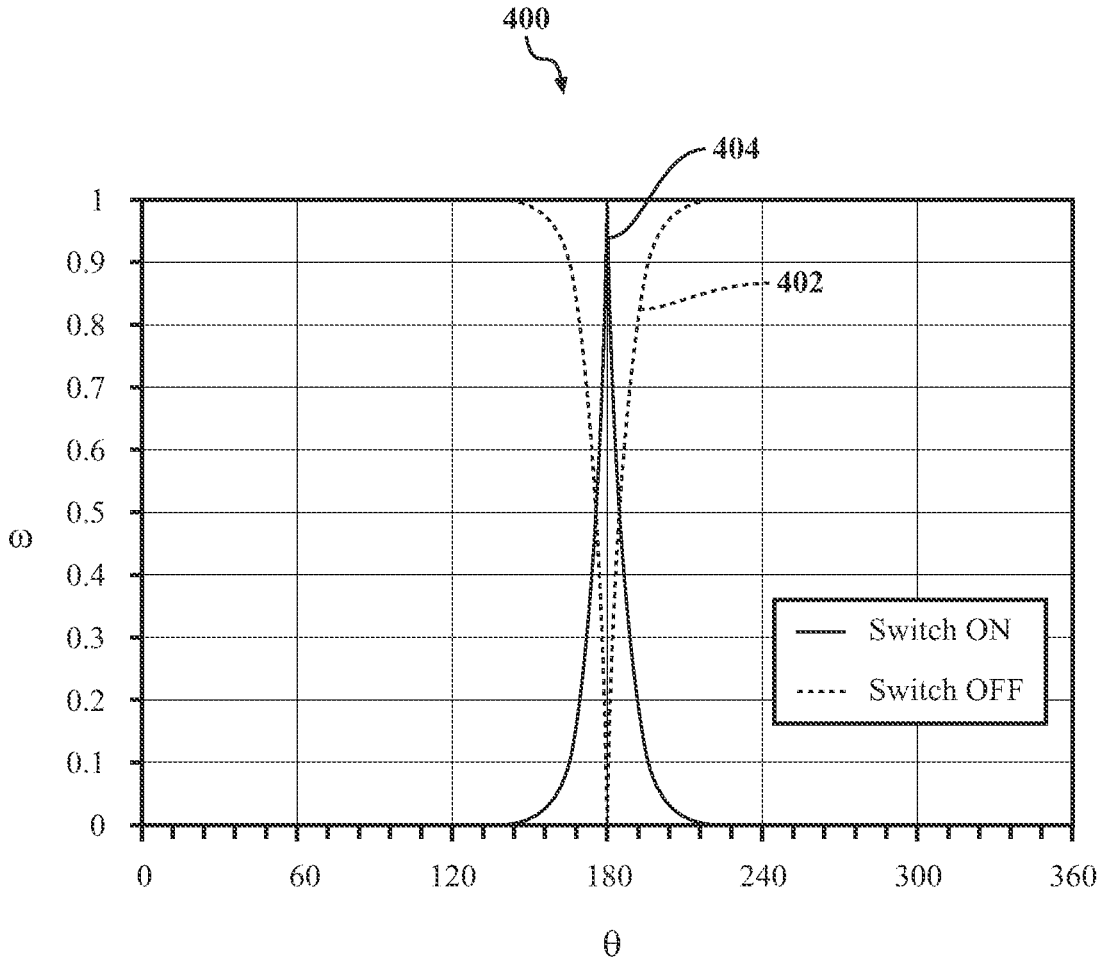
FIG. 4 schematically depicts a graphical representation of a temperature-dependent angular surface emissivity distribution of the emitter device of FIG. 1A, according to one or more embodiments shown and described herein.

Now referring to FIG. 4, a graphical representation 400 of a temperature-dependent angular surface emissivity distribution of the emitter device 12 is schematically depicted. As depicted in FIG. 4, the ordinate is an angular switchable emissivity (ω) and the abscissa is the degrees theta (θ). Line 402 illustrates that the emissivity is spread around the 180 degrees when the temperature of the emitter device 12 is below the predetermined temperature. As such, line 402 uses the first and second coating materials 70*a*, 70*b* of the surface coating pattern 20*a* to spread the radiated heat. Line 404 illustrates that the emissivity peaks with theta=180 degrees when the temperature of the emitter device 12 is below the predetermined temperature. As such, line 402 uses the first and third coating materials 70*a*, 70*c* of the surface coating pattern 20*a* to focus the radiated heat.

Figure 5A:
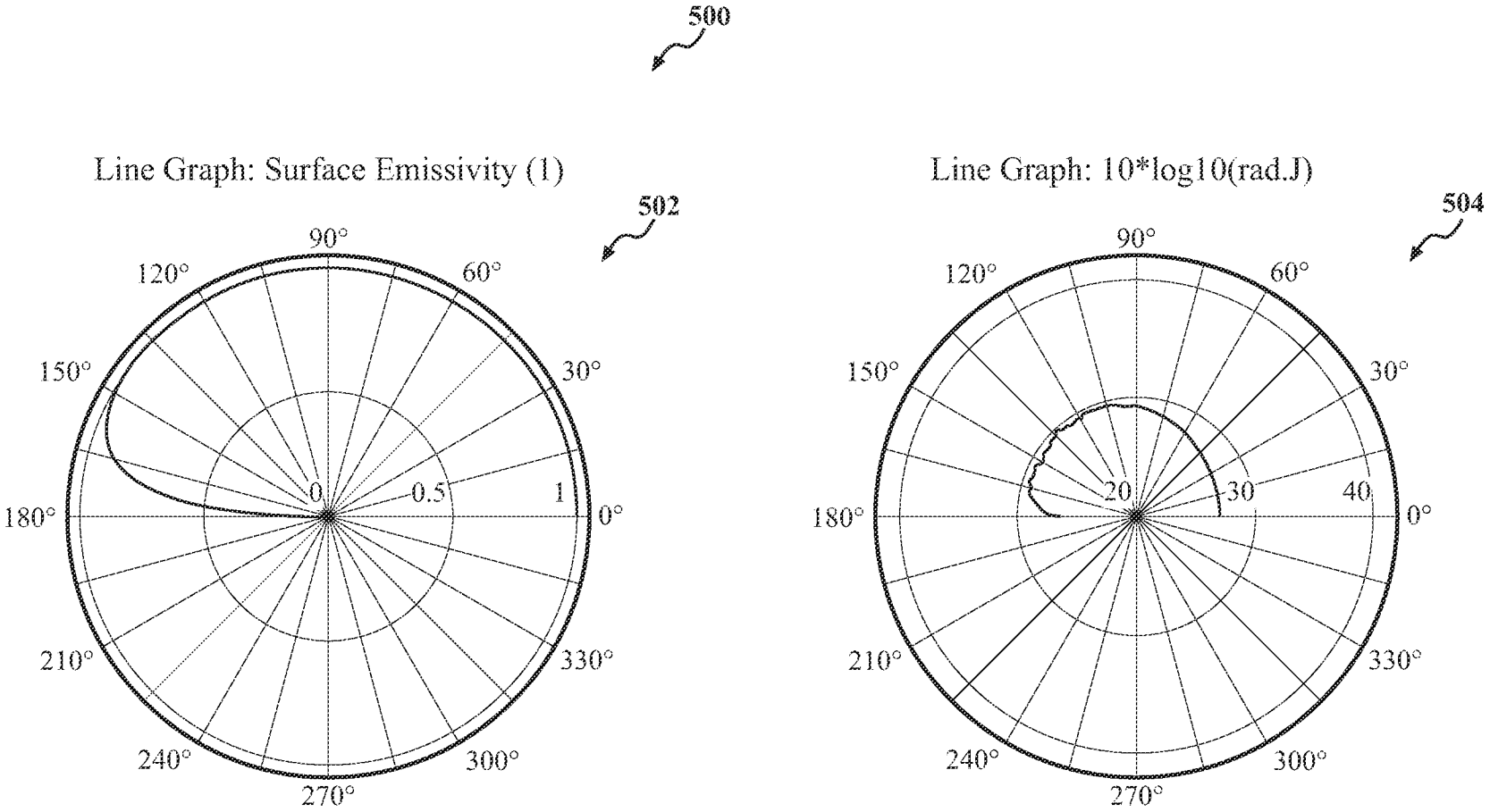
FIG. 5A schematically depicts a radiation distribution of the emitter device of FIG. 1 when the temperature of the emitter device is below the predetermined temperature according to one or more embodiments shown and described herein.

Now referring to FIG. 5A, a radiation distribution graph 500 of the emitter device 212 when the temperature of the emitter device 212 is below the predetermined temperature is schematically depicted. As illustrated in graph 502, the radiation from the emitter device 212 at 180 degrees approaches 1 such that, the radiation from the emitter device 212 extends generally uniformly and radially around a circumference of the cylinder surface to the 0 degree. As such, the radiation is distributed to both the first receiver device 14 and the second receiver device 16. Similarly, as illustrated in graph 504, the radiation from the emitter device 212 initially extends at the 180 degrees and approaches 30 such that, the radiation from the emitter device 212 extends generally uniformly and radially around a center portion of the cylinder surface to the 0 degree. As such, the radiation is distributed to both the first receiver device 14 and the second receiver device 16.

Figure 5B:
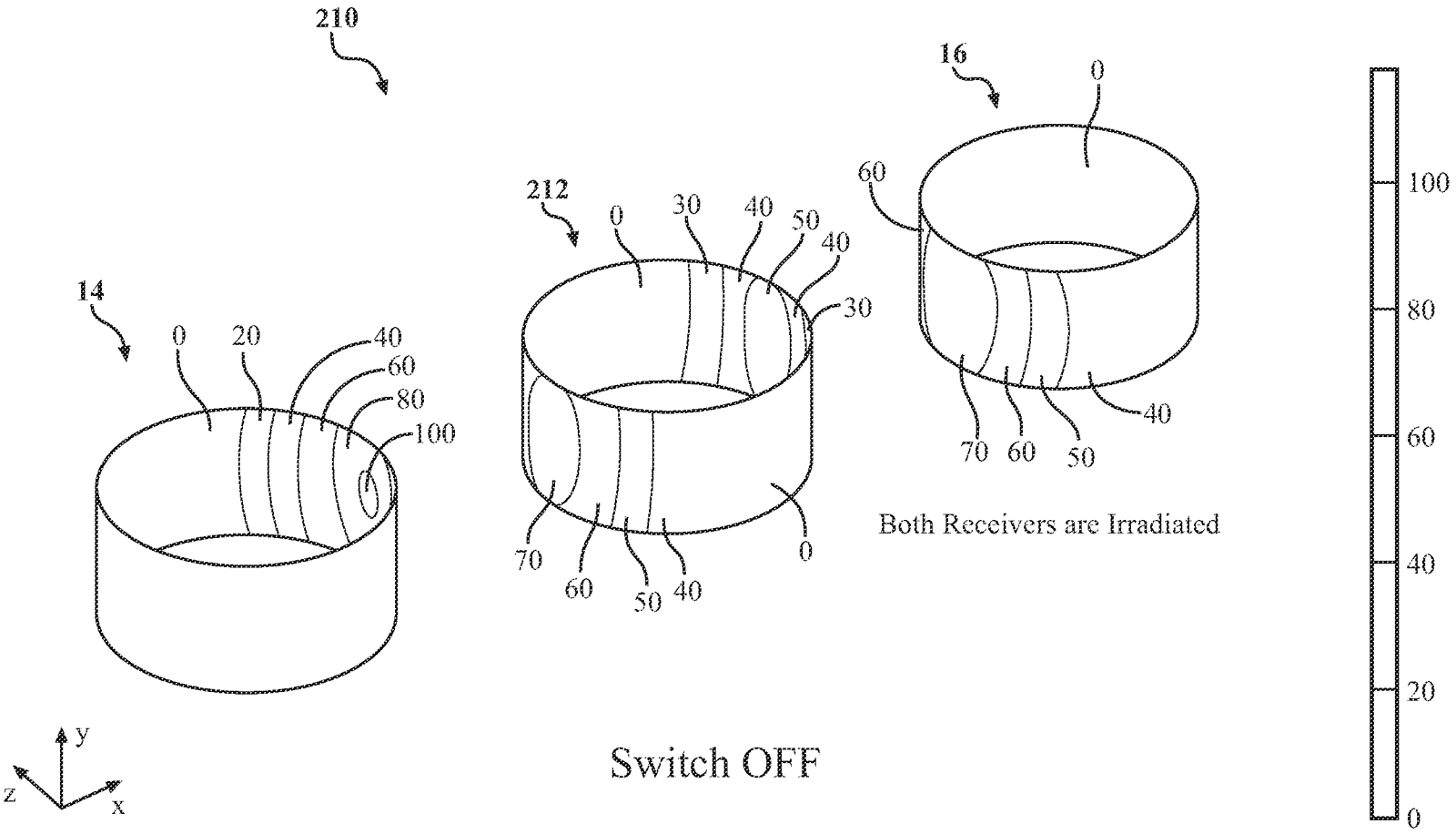
FIG. 5B schematically depicts a perspective and side view of the heat transfer system of FIG. 1A depicting a heat flux for a mutual surface irradiation when the temperature of the emitter device is below the predetermined temperature threshold, according to one or more embodiments shown and described herein.

Now referring to FIG. 5B, a heat flux for a mutual surface irradiation ($W/m^2$) of the emitter device 212 and the first and second receiver devices 14, 16 when the temperature of the emitter device 12 is below the predetermined temperature threshold is schematically depicted. It should be understood that the heat flux is a function of the different material coatings 270*a*, 270*b*, 270*c* of the surface coating pattern 220*a*, the geometry between the shape of the emitter device 212 and the shape of the first and second receiver devices 14, 16. Further, the heat flux is dependent on the geometry between the positions of the emitter device 212 with respect to the first and second receiver devices 14, 16. As illustrated, the geometry permits a differing heat flux between each of the receiver devices 14, 16 with respect to the emitter device 212. At its peak, the heat flux for the surface irradiation is approximately 100 $W/m^2$ on the first receiver device 14 and the surface irradiation is approximately 70 $W/m^2$ on the second receiver device 16. As such, the radiation dispersed from the emitter device 212 is spread to both the first and second receiver devices 14, 16 in a near uniform manner.

That is, as shown, the radiation extends a length, or circumference, of the outer surface 220 of the emitter device 212 and is generally extends between theta (θ) equal to 180 degrees to theta (θ) equal to 0 degrees. In some embodiments, the radiation of the emitter device 212 changes as it moves around the circumference of the outer surface 220 of the emitter device 212. In other embodiments, the radiation of the emitter device 212 remains generally uniform changes as it moves around the circumference of the outer surface 220 of the emitter device 212.

Figure 6A:
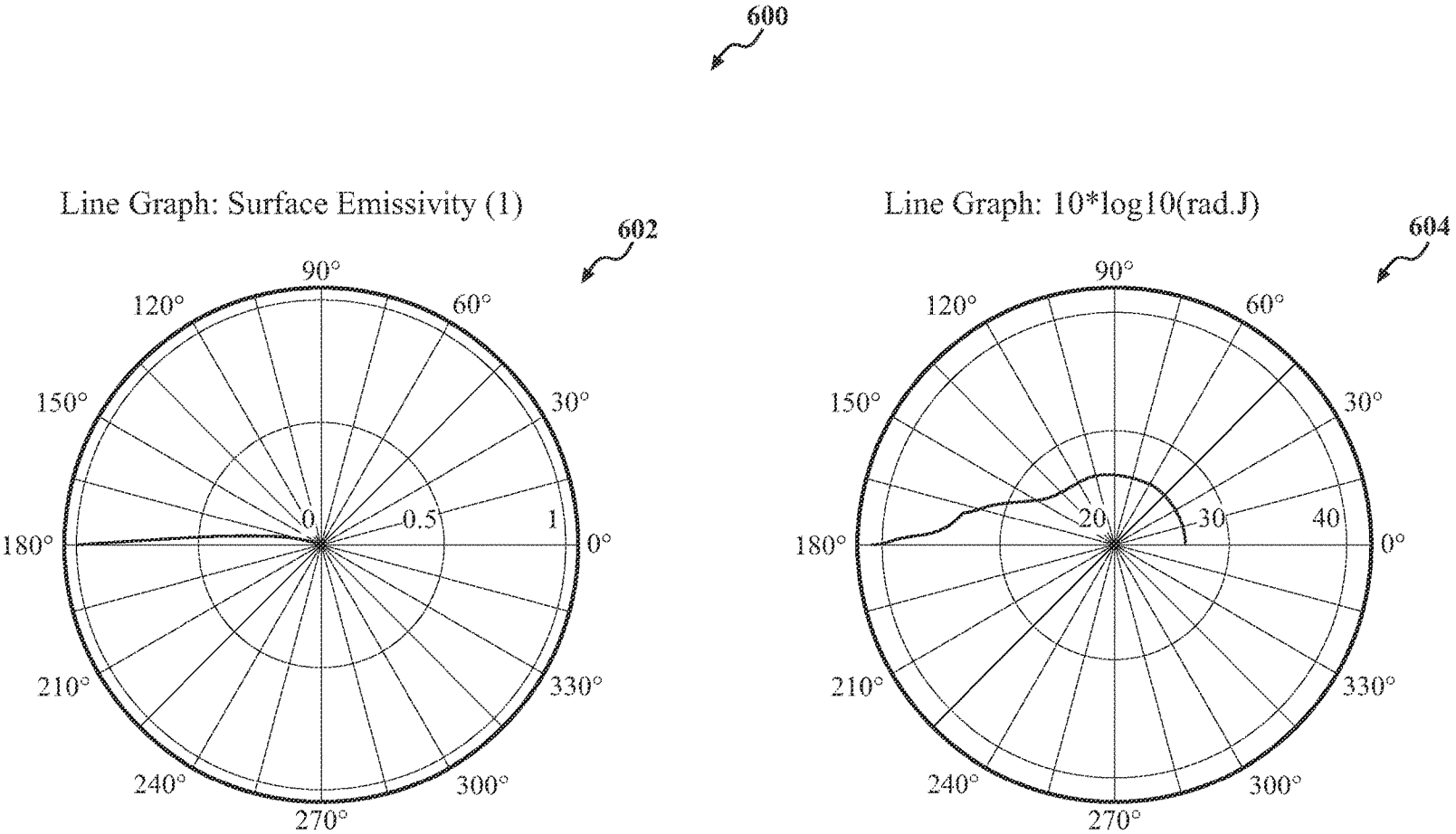
FIG. 6A schematically depicts a radiation distribution of the emitter device of FIG. 1A when the temperature of the emitter device exceeds the predetermined temperature according to one or more embodiments shown and described herein.

Now referring to FIG. 6A, a radiation distribution graph 600 of the emitter device 212 when the temperature of the emitter device 212 exceeds the predetermined temperature is schematically depicted. As illustrated in graph 502, the radiation from the emitter device 212 extends at 180 degrees via the composite material pattern 228 and the third material coating 270*c* such that, the radiation from the emitter device 212 extends generally to focus the radiation onto the first receiver device 14. That is, the radiation from the emitter device 212 is distributed to only the first receiver device 14 and the second receiver device 16 is shielded from any radiation. Similarly, as illustrated in graph 604, the radiation from the emitter device 212 extends at the 180 degrees to focus the radiation from the emitter device 212 to the first receiver device 14 and generally shields the second receiver device 16 from any radiation.

Figure 6B:
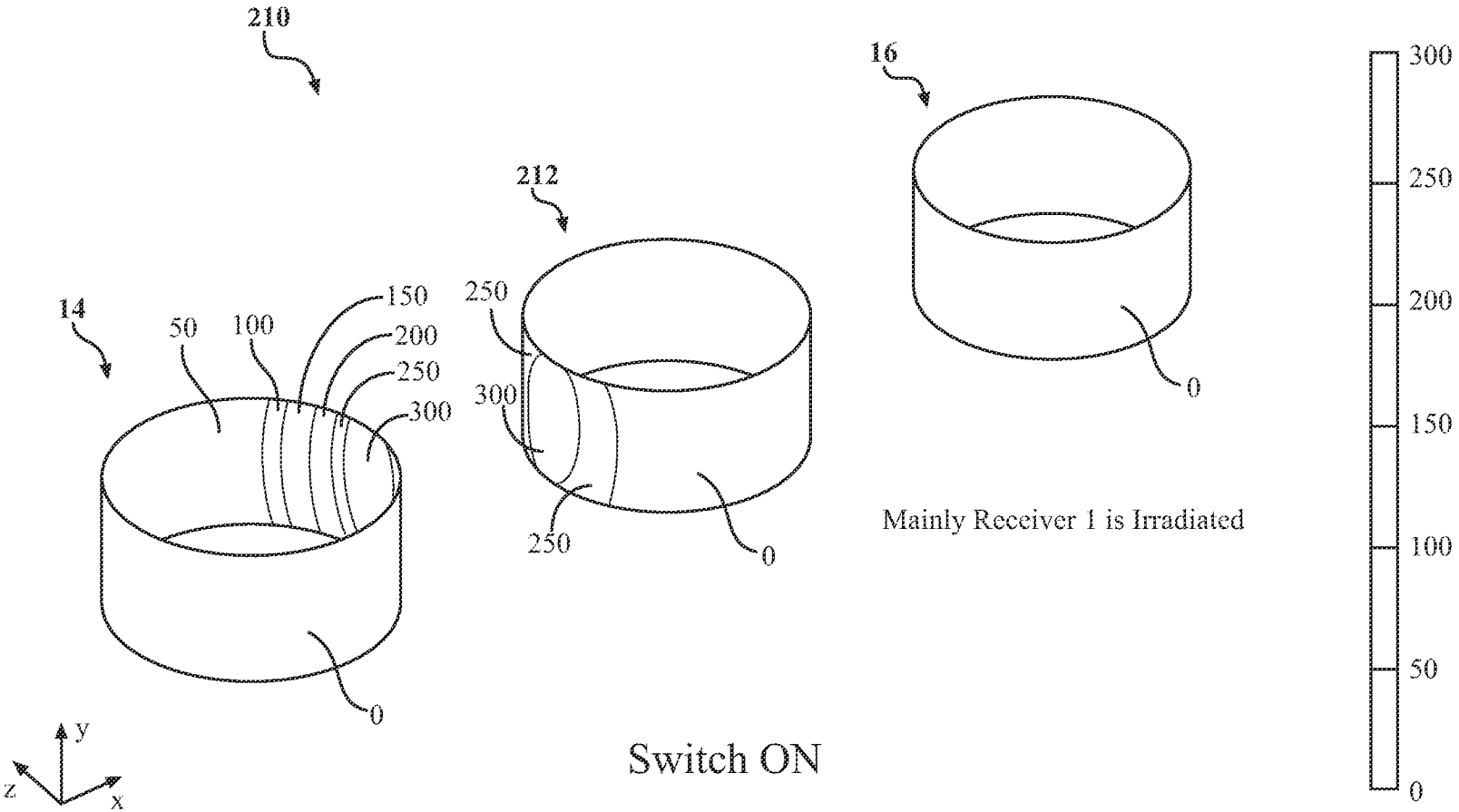
FIG. 6B schematically depicts a perspective and side view of the heat transfer system of FIG. 1 depicting a heat flux for a mutual surface irradiation when the temperature of the emitter device exceeds the predetermined temperature threshold, according to one or more embodiments shown and described herein.

Now referring to FIG. 6B, a heat flux for a mutual surface irradiation ($W/m^2$) of the emitter device 212 and the first and second receiver devices 14, 16 when the temperature of the emitter device 12 exceeds the predetermined temperature threshold is schematically depicted. At its peak, the heat flux for the surface irradiation is approximately 300 $W/m^2$ on the first receiver device 14 and the surface irradiation is approximately 0 $W/m^2$ on the second receiver device 16. As such, the radiation dispersed from the emitter device 212 is focused onto the first receiver device 14 and is shielded from the second receiver device 16.

Figure 7:
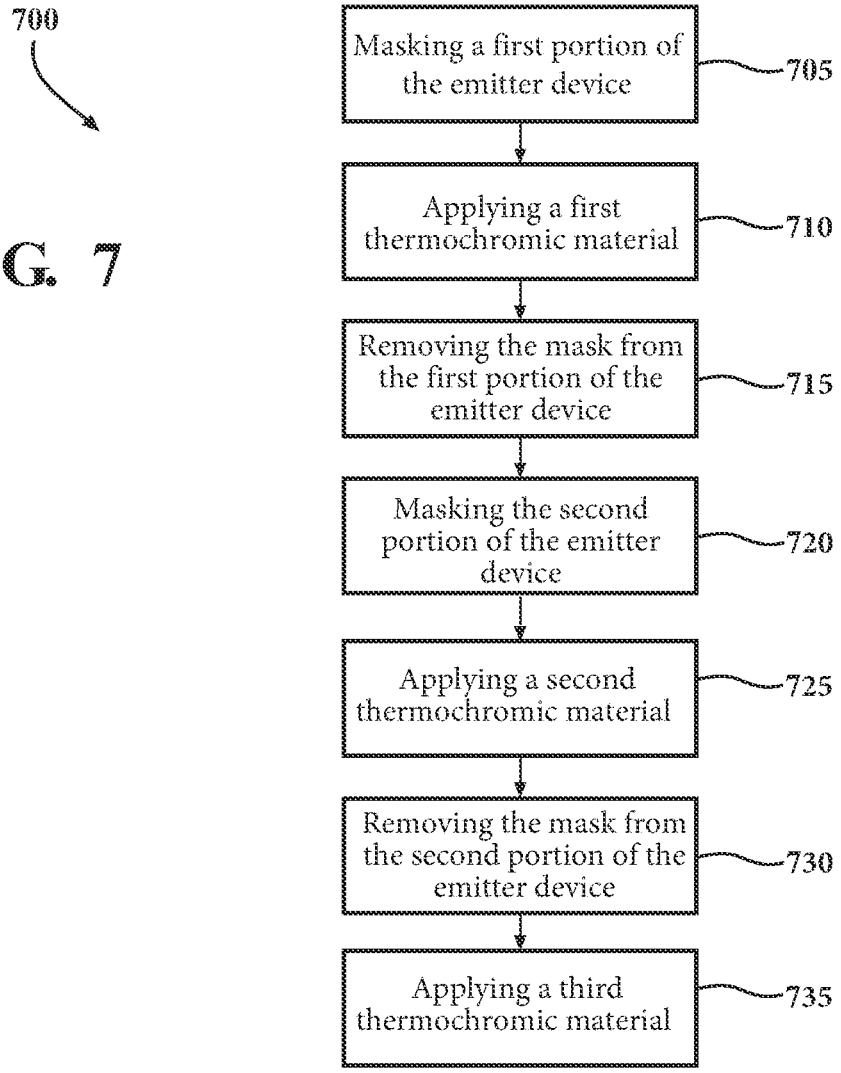
FIG. 7 depicts a flowchart of an illustrative method for forming a surface coating pattern of the emitter device of the heat transfer system of FIG. 1A according to one or more embodiments shown or described herein.

Now referring to FIG. 7, an illustrative method 700 of forming the surface coating pattern 20*a* of the emitter device 12 of the power transfer system 10 is depicted. Although the steps associated with the blocks of FIG. 7 will be described as being separate tasks, in other embodiments, the blocks may be combined or omitted. Further, while the steps associated with the blocks of FIG. 7 will described as being performed in a particular order, in other embodiments, the steps may be performed in a different order.

At block 705, a first portion of the emitter device is masked. At block 710, a first thermochromic material is applied to, coated with, or spun onto, the emitter device. The first thermochromic material circumferentially coats at least a second portion of an outer surface of the emitter device. At block 715, the mask is removed from the first portion of the emitter device. At block 720, the second portion of the emitter device is masked. At block 725, a second thermochromic material is applied to, coated with, or spun onto, the emitter device. The second thermochromic material circumferentially coats at least the first portion of the outer surface of the emitter device. In some embodiments, the first portion of the outer surface of the emitter device is the composite material pattern. At block 730, the mask is removed from the second portion of the emitter device and, at block 735, a third thermochromic material is applied to, coated with, or spun onto the emitter device. The third thermochromic material coats the first thermochromic material and the second thermochromic material of the emitter device.

It should be appreciated that the embodiments described herein relate to a multimode heat transfer system and/or a power transfer system. The system includes an emitter device and a pair of receiver devices. The emitter device includes an inner core surrounded by an outer core having a thickness and an outer surface. A composite material pattern extends through at least a portion of the outer surface and at least a portion of the thickness of the outer core and is thermally coupled to the inner core. The composite material pattern directs a heat from the inner core to an object other than the emitter device. The composite material pattern may be a plurality of shapes and sizes and may be optimized to maximize a heat and/or power transfer.

Further, the outer surface includes a surface coating pattern that, based on a function of temperature of the emitter device, switches the emitter device from transferring a radiated heat between both first and second receiver devices in an onmi-directional pattern to focusing the heat transfer solely onto the first receiver device while shielding the second receiver device.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A multi-mode heat transfer system comprising:

an emitter device comprising:

an inner core surrounded by an outer core having a thickness and an outer surface;

a composite material pattern extending through at least a portion of the outer surface and at least a portion of the thickness of the outer core and is thermally coupled to the inner core; and a surface coating pattern on the outer surface that is changeable between a low emissivity state and a high emissivity state based on a surface temperature of the emitter device, wherein in the low emissivity state, the emitter device transmits an omni-directional radiation and, in the high emissivity state, the emitter device transmits a focused radiation via the composite material pattern.

2. The multi-mode heat transfer system of claim 1, further comprising:

a first receiver device, the first receiver device is spaced part from the emitter device and is configured to receive heat directed from the composite material pattern when the in the emitter device is in the high emissivity state.

3. The multi-mode heat transfer system of claim 2 further comprising:

a second receiver device, the second receiver device is spaced apart from the first receiver device, the emitter device is positioned between the first and second receiver devices, the emitter device directs heat to both the first receiver device and the second receiver device when the emitter device is in the low emissivity state.

4. The multi-mode heat transfer system of claim 3, wherein the emitter device is cylindrical in shape having a plurality of stacked annular rings in a system vertical direction.

5. The multi-mode heat transfer system of claim 1, wherein the surface coating pattern includes a first coating material and a second coating material.

6. The multi-mode heat transfer system of claim 5, wherein the first coating material covers the outer surface of the emitter device.

7. The multi-mode heat transfer system of claim 6, wherein the first coating material is activated when the surface temperature of the outer surface of the emitter device is below a predetermined threshold.

8. The multi-mode heat transfer system of claim 6, wherein the second coating material covers only the composite material pattern of the outer surface of the emitter device.

9. The multi-mode heat transfer system of claim 8, wherein the second coating material is activated when the surface temperature of the outer surface of the emitter device is above a predetermined threshold.

10. The multi-mode heat transfer system of claim 9, wherein when in the low emissivity state, the first coating material of the emitter device enables the transmission of the omni-directional radiation and, when in the high emissivity state, the second coating material of the emitter device enables the transmission of the focused radiation via the composite material pattern.

11. A power transfer system comprising:

an emitter device comprising:

an inner core and an outer core having a thickness that circumferentially surrounds the inner core and an outer surface, the outer core comprising at least one high thermal conductivity material inlay and a low thermal conductivity material matrix;

a composite material pattern is formed by the materials, wherein the composite material pattern extends a length of the emitter device in a system vertical direction and is positioned within a portion of the thickness of the outer core;

a surface coating pattern on the outer surface that is changeable between a low emissivity state and a high emissivity state based on a surface temperature of the emitter device;

a first receiver device; and a second receiver device, the emitter device is positioned spaced part from and in between the first and second receiver devices, wherein in the low emissivity state, the emitter device transmits an omni-directional radiation to the first and second receiver devices, and, in the high emissivity state, the emitter device transmits a focused radiation via the composite material pattern to the first receiver device.

12. The power transfer system of claim 11, wherein the emitter device is cylindrical in shape having a plurality of stacked annular rings in the system vertical direction.

13. The power transfer system of claim 11, wherein the surface coating pattern includes a first coating material and a second coating material.

14. The power transfer system of claim 13, wherein the first coating material covers the outer surface of the emitter device.

15. The power transfer system of claim 14, wherein the first coating material is activated when the surface temperature of the outer surface of the emitter device is below a predetermined threshold.

16. The power transfer system of claim 14, wherein the second coating material covers only the composite material pattern of the outer surface of the emitter device.

17. The power transfer system of claim 16, wherein the second coating material is activated when the surface temperature of the outer surface of the emitter device is above a predetermined threshold.

18. The power transfer system of claim 17, wherein when in the low emissivity state, the first coating material of the emitter device enables the transmission of the omni-directional radiation and, when in the high emissivity state, the second coating material of the emitter device enables the transmission of the focused radiation via the composite material pattern.

19. A method of forming a surface coating pattern of an emitter device in a power transfer system such that the emitter device has a switchable emissivity profile based on a function of a temperature of the emitter device, the method comprising:

masking a first portion of the emitter device;

applying a first thermochromic material to circumferentially cover at least a second portion of an outer surface of the emitter device;

removing the mask from the first portion of the emitter device;

masking the second portion of the emitter device;

applying a second thermochromic material to circumferentially cover at least the first portion of the outer surface of the emitter device; and removing the mask from the second portion of the emitter device;

applying a third thermochromic material to cover the first thermochromic material and the second thermochromic material of the emitter device.

20. The method of claim 19 wherein the first portion of the outer surface of the emitter device is a composite material pattern.

* * * * *